US006439190B1

(12) United States Patent
Bochum

(10) Patent No.: US 6,439,190 B1
(45) Date of Patent: Aug. 27, 2002

(54) METHOD FOR OPERATING AN INTERNAL COMBUSTION ENGINE, ESPECIALLY OF AN AUTOMOBILE

(75) Inventor: Hansjoerg Bochum, Novi, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/720,026

(22) PCT Filed: Jun. 12, 1999

(86) PCT No.: PCT/DE99/01730

§ 371 (c)(1),
(2), (4) Date: Dec. 20, 2000

(87) PCT Pub. No.: WO99/67526

PCT Pub. Date: Dec. 29, 1999

(30) Foreign Application Priority Data

Jun. 20, 1998 (DE) ..... 198 27 609

(51) Int. Cl.[7] ..... F02B 17/00
(52) U.S. Cl. ..... 123/295; 123/491
(58) Field of Search ..... 123/295, 478, 123/491

(56) References Cited

U.S. PATENT DOCUMENTS 4,785,786 A 11/1988 Nagao et al.
5,313,924 A 5/1994 Requeiro
5,331,933 A * 7/1994 Matsushita ..... 123/295
5,718,203 A * 2/1998 Shimada et al. ..... 123/435
5,785,031 A * 7/1998 Akimoto et al. ..... 123/295
5,924,405 A * 7/1999 Hashimoto ..... 123/295
5,941,209 A * 8/1999 Hashimoto ..... 123/305
6,148,802 A * 11/2000 Moser et al. ..... 123/304

FOREIGN PATENT DOCUMENTS

| | | |
|---|---|---|
| DE | 197 39 786 | 4/1998 |
| EP | 0 849 455 | 6/1998 |
| EP | 0 849 460 | 6/1998 |
| GB | 2317028 A * | 11/1998 |
| JP | 09 166039 | 10/1997 |

* cited by examiner

*Primary Examiner*—Erick Solis
(74) *Attorney, Agent, or Firm*—Walter Ottesen

(57) ABSTRACT

An internal combustion engine (1), especially for a motor vehicle, is described and is provided with an injection valve (9) with which the fuel, which is to be injected for a combustion, can be injected directly into a combustion chamber (4) during an induction phase and during a compression phase. A control apparatus (12) is provided for controlling (open loop and/or closed loop) the fuel mass injected into the combustion chamber (4). A pressure sensor is provided for measuring the pressure with which the fuel is injected into the combustion chamber (4). The fuel is injected via the control apparatus (12) during the induction phase when the pressure is less than a pregivable minimum pressure.

10 Claims, 3 Drawing Sheets

METHOD FOR OPERATING AN INTERNAL COMBUSTION ENGINE, ESPECIALLY OF AN AUTOMOBILE

FIELD OF THE INVENTION

The invention relates to a method for operating an internal combustion engine, especially of a motor vehicle. In the method, the fuel, which is to be injected for a combustion, is injected directly into a combustion chamber during an induction phase and during a compression phase. Furthermore, the invention relates to an internal combustion engine, especially for a motor vehicle. The engine has an injection valve with which the fuel, which is to be injected for a combustion, can be injected directly into a combustion chamber during an induction phase and during a compression phase. The engine has a control apparatus for controlling (open loop and/or closed loop) the fuel mass injected into the combustion chamber.

BACKGROUND OF THE INVENTION

Systems for the direct injection of fuel into the combustion chamber of an internal combustion engine are generally known. In these systems, a so-called stratified operation and a so-called homogeneous operation are distinguished. The stratified operation is used especially for smaller loads; whereas, the homogeneous operation is applied for larger loads applied to the engine.

In stratified operation, the fuel is injected into the combustion chamber during the compression phase of the engine in such a manner that, at the time point of the ignition, a fuel cloud is located in the direct vicinity of the spark plug. This injection can take place in different ways. Thus, it is possible that the injected fuel cloud is already located at the spark plug during or directly after the injection and is ignited by the spark plug. Likewise, it is possible that the injected fuel cloud is conducted to the spark plug via a charge movement and is only then ignited. In both combustion methods, no uniform fuel distribution is present, instead, a stratified charge is present.

The advantage of the stratified operation is that there, with a very small fuel quantity, the applied smaller loads can be taken care of by the engine. Larger loads can, however, not be satisfied with the stratified operation.

In homogeneous operation, which is provided for such larger loads, the fuel is injected during the induction phase of the engine so that a swirling and therefore a distribution of the fuel can still easily take place in the combustion chamber. To this extent, the homogeneous operation corresponds approximately to the operation of internal combustion engines wherein fuel is injected into the intake manifold in the conventional manner. As required, the homogeneous operation can be used also for smaller loads.

So that an injection of fuel in the compression phase of the engine can take place, that is, in stratified operation, it is generally necessary that a high pressure is present for this injection. If this is not the case, then the possibility is present of a so-called backblowing of a combusted mixture of the previous combustion as well as of the inducted combustion air from the combustion chamber back into the pressure store.

After the engine has been at standstill, the high pressure, which is necessary for the stratified operation, is usually not present. For this reason, a switchover into stratified operation cannot take place immediately when starting the engine even though this would be desirable for reasons especially of saving fuel.

SUMMARY OF THE INVENTION

The object of the invention is to provide a method for operating an internal combustion engine as well as to provide an internal combustion engine with which the described backblowing is generally avoided and with which especially a starting of the engine is possible with a saving of fuel as great as possible.

The task is solved in a method of the initially-mentioned type in accordance with the invention in that the pressure is determined with which the fuel is injected into the combustion chamber and the fuel is injected during the induction phase when the pressure is less than a pregivable minimum pressure. In an internal combustion engine of the initially-mentioned type, the task is solved in accordance with the invention in that a pressure sensor is provided for measuring the pressure with which the fuel is injected into the combustion chamber and that, via the control apparatus, the fuel is injected during the induction phase when the pressure is less than a pregivable minimum pressure.

In this way, it is ensured that there is no switch into the stratified operation when the pressure is too low. Instead, in this case, the engine is operated in homogeneous operation. Generally, and especially when starting the engine, it is achieved in this manner that a backblowing of combusted mixture from the combustion chamber back into the pressure store is reliably avoided. At the same time, however, and, inter alia, when starting the engine, the pressure in the pressure store is further increased because of the injections in the induction phase and because of the first ignitions of the engine which result therefrom so that the above-mentioned pressure increases in such a manner relatively rapidly and the high pressure, which is needed for the stratified operation, is reached.

In an advantageous embodiment of the invention, the fuel is injected during the compression phase when the pressure is greater than the pregivable minimum pressure. If the pressure in the pressure store has reached the high value in this way, especially when starting the engine, then the engine is operated in stratified operation. This affords the advantage of saving fuel and reducing toxic substances.

It is advantageous when the fuel is injected again during the induction phase when the pressure is less than a pregivable hysteresis pressure. The hysteresis pressure is less than the minimum pressure. In this way, a hysteresis is built up which reliably avoids a continuous sequential back and forth switching between the stratified operation and the homogeneous operation in the region of minimum pressure.

In an advantageous embodiment of the invention, the pressure, with which the fuel is injected into the combustion chamber, is controlled (open loop and/or closed loop) to a maximum pressure. This defines a pressure control of the pressure in the pressure store with which this pressure is limited to the maximum pressure.

It is important that the method of the invention can be generally used for the operation of the internal combustion engine. The use of the method of the invention is especially advantageous during starting of the engine, especially when the rpm of the engine is less than a pregivable start-end threshold. With this use of the method of the invention during the starting of the engine, a start operation can be generated, which is combined from an initial homogeneous operation and a subsequent stratified operation which reduces the disadvantages of the homogeneous operation, especially the high fuel consumption thereof, to a minimum and which simultaneously brings out the advantages of the stratified operation as early as possible.

The realization of the method of the invention in the form of a control element is of special significance. The control element is provided for a control apparatus of the engine, especially of a motor vehicle. A program is stored on the control element which can be run on a control apparatus, especially on a microprocessor, and is suitable for carrying out the method of the invention. In this case, the invention is therefore realized by a program which is stored on the control element so that this control element, which is provided with the program, defines the invention in the same way as the method for whose execution the program is suitable. As a control element, especially an electric storage medium can be used, such as a read-only-memory.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
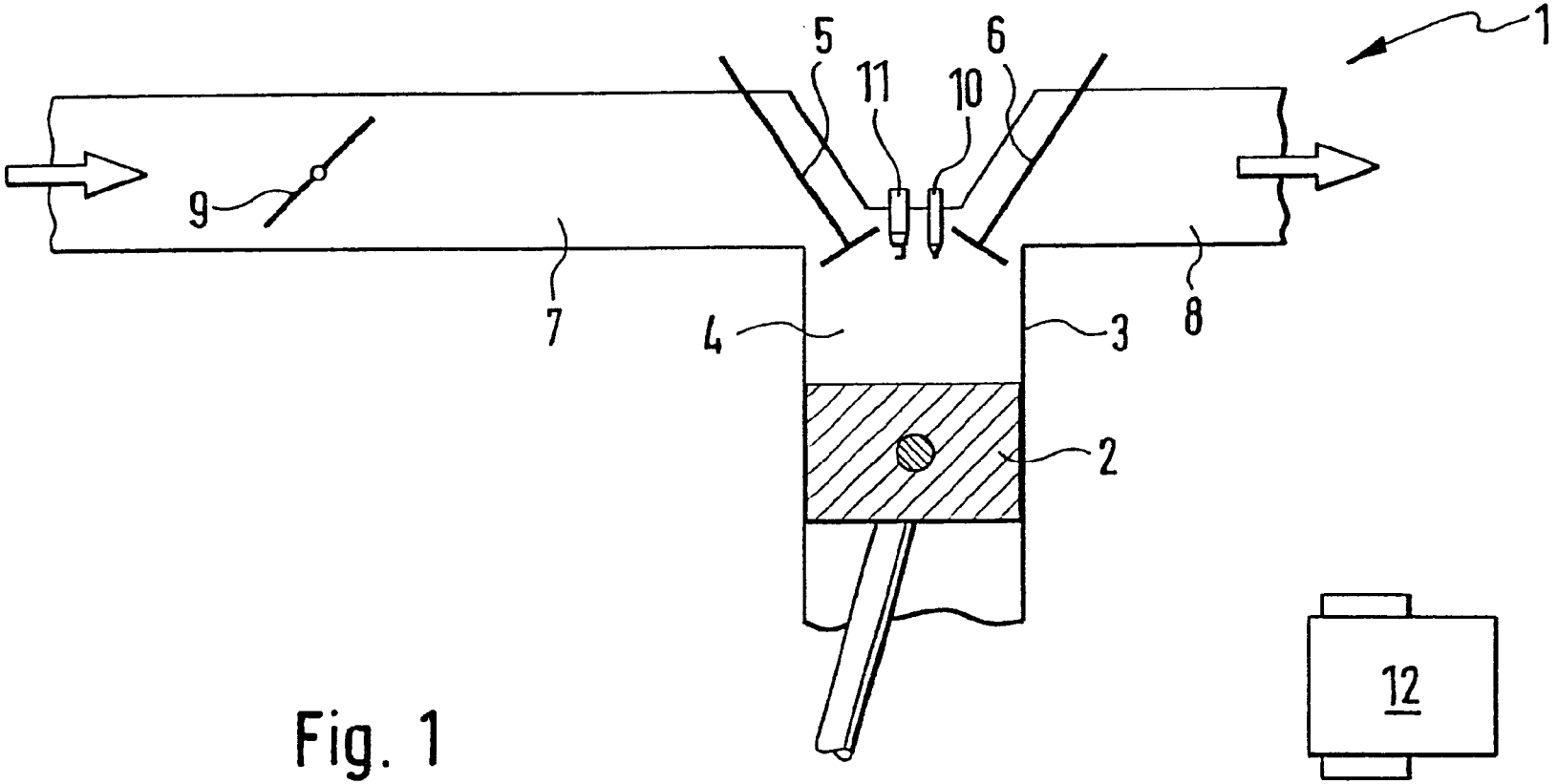
FIG. 1 shows a schematic block circuit diagram of an embodiment of the internal combustion engine of the invention.

In FIG. 1, an internal combustion engine 1 of a motor vehicle is shown wherein a piston 2 is movable back and forth in cylinder 3. The cylinder 3 is provided with a combustion chamber 4 which is delimited, inter alia, by the piston 2, an inlet valve 5 and an outlet valve 6. An intake manifold 7 is connected with the inlet valve 5 and an exhaust-gas pipe 8 is connected with the outlet valve 6.

A rotatable throttle flap 9 is mounted in the intake manifold 7 and air can be supplied to the intake manifold 7 via the throttle flap 9. The quantity of the supplied air is dependent upon the angular position of the throttle flap 9.

An injection valve 10 is assigned to the cylinder 3 and fuel can be injected into the combustion chamber 4 of the engine 1 with the injection valve 10. Likewise, a spark plug 11 is assigned to the cylinder 3 with which the injected fuel can be ignited.

The throttle flap 9 is opened wide in a so-called stratified operation of the engine 1. The fuel is injected by the injection valve 10 into the combustion chamber 4 during a compression phase caused by the piston 2 and this injection is local in the immediate vicinity of the spark plug 11 as well as in a suitable time interval in advance of the ignition time point. Then, the fuel is ignited with the aid of the spark plug 11 so that the piston 2 is driven in the following work phase by the expansion of the ignited fuel.

In a so-called homogeneous operation of the engine 1, the throttle flap 9 is partially opened or closed in dependence upon the desired supplied air mass. The fuel is injected into the combustion chamber 4 by the injection valve 10 during an induction phase caused by the piston 2. The injected fuel is swirled by the simultaneously inducted air and thereby essentially uniformly distributed in the combustion chamber 4. Thereafter, the air/fuel mixture is compressed during the compression phase in order to then be ignited by the spark plug 11. The piston 2 is driven by the expansion of the ignited fuel.

The fuel mass, which is injected into the combustion chamber 4 in the stratified operation and in the homogeneous operation by the injection valve 10, is controlled (open loop and/or closed loop) by a control apparatus 12 especially with a view toward a low fuel consumption and/or a low development of toxic substances. For this purpose, the control apparatus 12 is provided with a microprocessor which has a program stored in a memory medium, especially in a read-only-memory, which is suitable to execute the above-mentioned control (open loop and/or closed loop).

Input signals are applied to the control apparatus 12 and these signals define operating variables of the engine 1 which are measured by means of sensors. For example, the control apparatus 12 is connected to an air mass sensor, a lambda sensor and an rpm sensor. Furthermore, the control apparatus 12 is connected to an accelerator pedal sensor which generates a signal which gives the position of an accelerator pedal which can be actuated by a driver. The control apparatus 12 generates output signals with which, via actuators, the performance of the engine 1 can be influenced in correspondence to the desired control (open loop and/or closed loop). For example, the control apparatus 12 is connected to the injection valve 10, the spark plug 11 and the throttle flap 9 and generates the signals required for driving the same.

Figure 2:
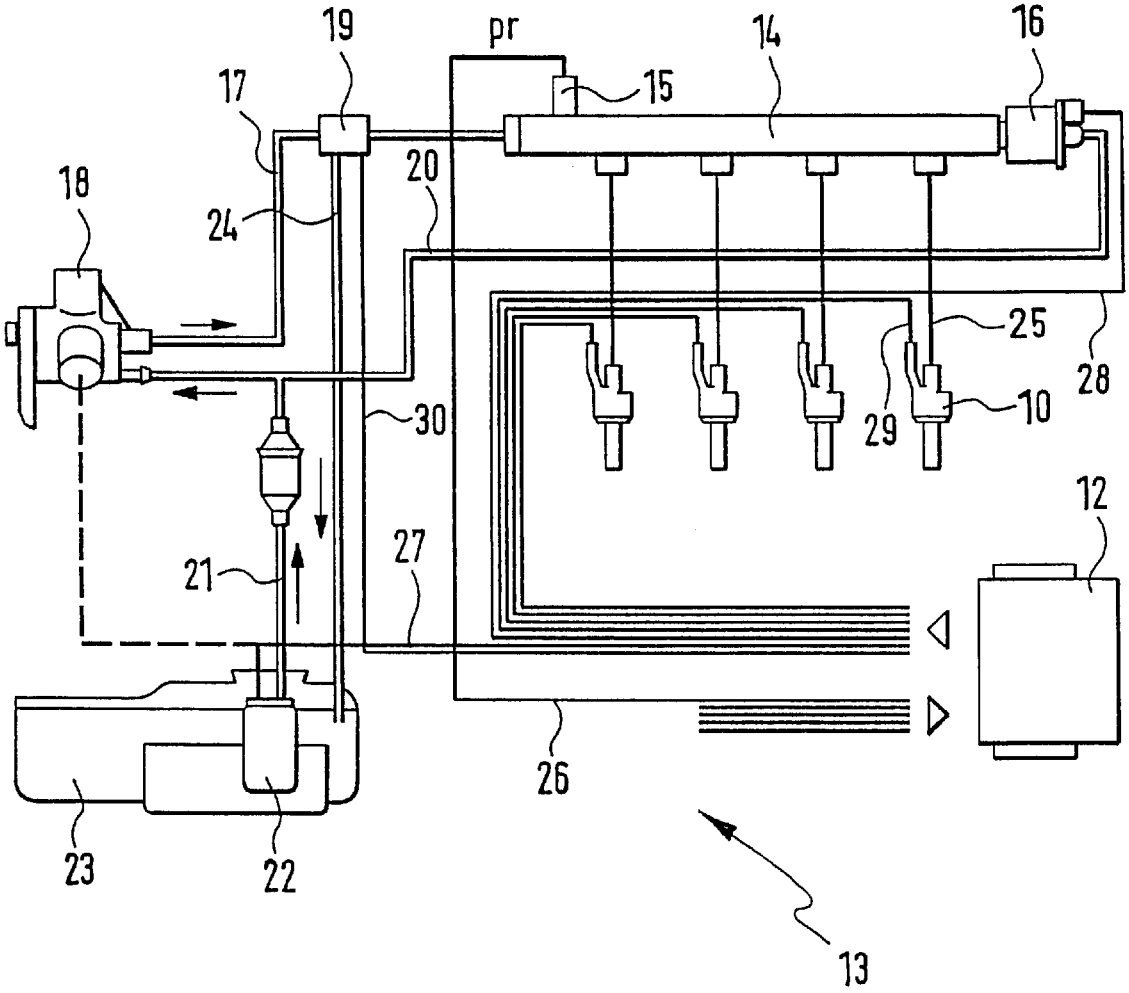
FIG. 2 shows a schematic block circuit diagram of a fuel supply system for the engine of FIG. 1; and, FIG. 3 shows a schematic illustration of a sequence diagram corresponding to an embodiment of the method of the invention.

In FIG. 2, a fuel supply system 13 is shown which is provided for use with the engine 1. The fuel supply system 12 is a so-called rail system which is especially utilized in an internal combustion engine having direct injection.

The fuel supply system 13 includes a pressure store 14 which is provided with a pressure sensor 15 and a pressure control valve 16. The pressure store 14 is connected via a pressure line 17 to a high pressure pump 18. A switchover valve 19 is connected into the pressure line 17 and connects the high pressure pump 18 to the pressure store 14 in the normal state. The high pressure pump 18 is connected via a pressure line 20 to the pressure control valve 16. The pressure control valve 16, and therefore also the high pressure pump 18, is connected to a fuel pump 22 via a high pressure line 21 and a filter. The fuel pump 22 is suited to draw fuel from a fuel vessel 23 by suction. The switchover valve 19 is connected to the fuel vessel 23 via a line 24.

The fuel supply system 13 includes four injection valves 10 which are connected via pressure lines 25 to the pressure store 14. The injection valves 10 are suitable for injecting fuel into the combustion chambers 4 of the engine 1. There, the fuel is ignited by means of spark plugs 11.

The pressure sensor 15 is connected to the control apparatus 12 by means of a signal line 26. A plurality of other signal lines are connected as input lines to the control apparatus 12. The fuel pump 22 is connected via a signal line 27 to the control apparatus 12 and the pressure control valve 16 is connected via a signal line 28 to the control apparatus 12. Alternatively, or in addition, the high pressure pump 18 can also be connected to the control apparatus 12. Furthermore, the injection valves 10 are connected via signal lines 29 to the control apparatus 12. Finally, the switchover valve 19 is connected via a signal line 30 to the control apparatus 12.

The pressure in the pressure store 14 is identified in FIG. 2 by pr. This pressure is measured by the pressure sensor 15 and is present at the signal line 26. This pressure pr is that pressure with which the fuel is injected into the combustion chamber 4 of the engine 1.

The fuel is pumped by the fuel pump 2 from the fuel vessel 23 to the high pressure pump 18. With the aid of the high pressure pump 18, the pressure pr is generated in the pressure store 14. The pressure pr is measured by the pressure sensor 15 and can be adjusted to a desired value by an appropriate actuation of the pressure control valve 16 and/or control of the fuel pump 22 or high pressure pump 18. The fuel is injected into the combustion chamber 4 of the engine 1 via the injection valves 10.

The pressure pr in the pressure store 14 is, inter alia, essential for determining the fuel quantity or fuel mass injected into the combustion chamber 4. The greater the pressure pr in the pressure store 14, the more fuel is injected into the combustion chamber 4 during the same injection time. For example, to satisfy a full load requested by the engine, the above-mentioned high pressure pr in the pressure store 14 is an essential precondition.

A high pressure pr in the pressure store 14 is likewise necessary when the engine 1 is to be operated in stratified operation, that is, when fuel is to be injected into the combustion chamber 4 in the compression phase. If there is not a sufficient high pressure pr in the pressure store 14, then a so-called backblowing occurs wherein a combusted mixture of the previous combustion (remaining from the last combustion) as well as inducted combustion air are pushed back from the combustion chamber 4 into the pressure store 14 because of the compression phase and because of the pressure in the combustion chamber 4 resulting therefrom. Only when the pressure pr in the pressure store 14 is greater than the pressure arising in the combustion chamber 4 during the compression phase does an injection of fuel actually take place from the pressure store 14 into the combustion chamber 4 of the engine 1.

A high pressure pr of this kind is especially usually not present in the pressure store 14 after a standstill of the engine 1. For this reason, there cannot be an immediate switchover into the stratified operation when starting the engine 1, at least not easily.

Figure 3:
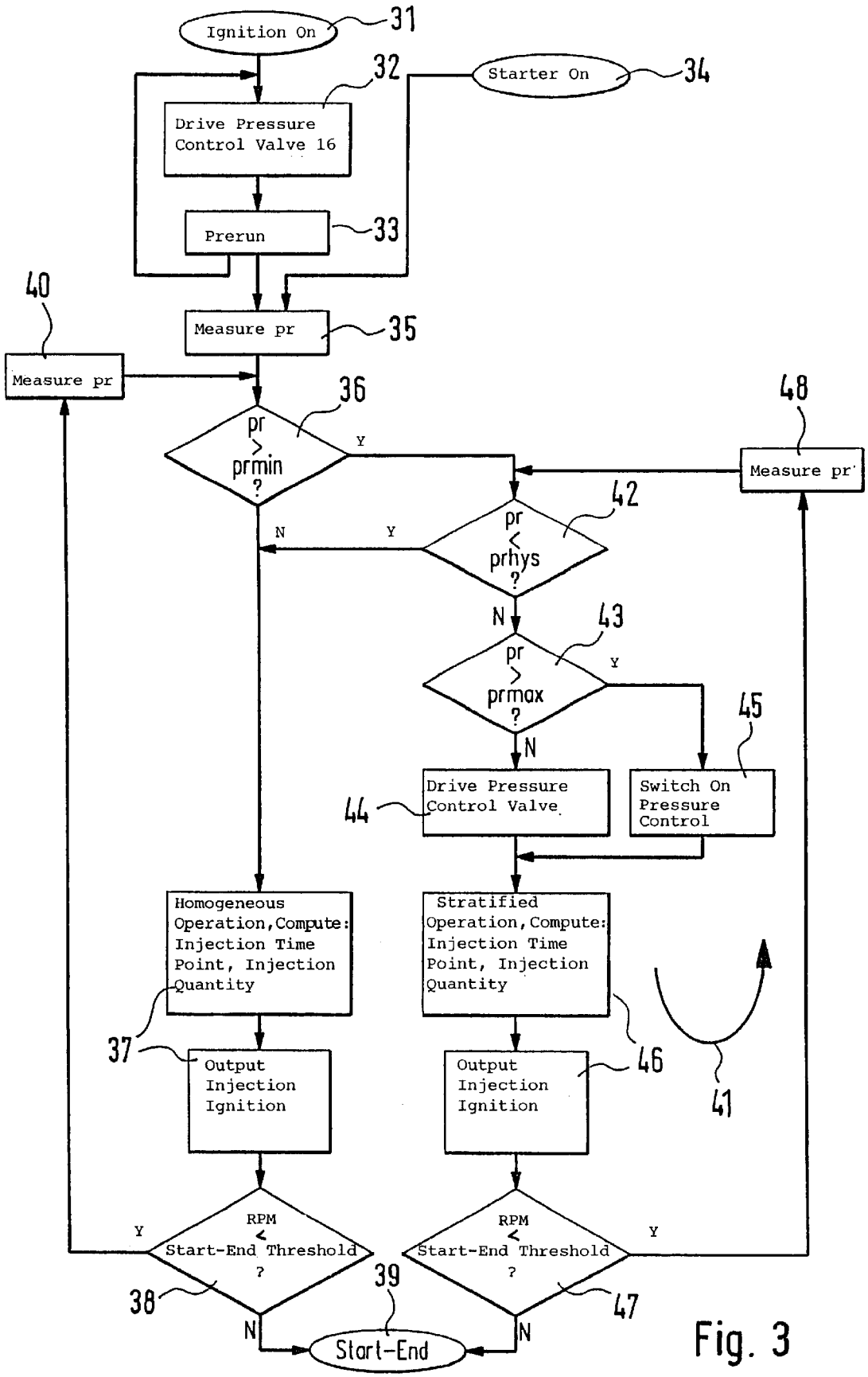

The method for operating the engine 1 is described hereinafter with respect to FIG. 3 and is carried out by the control apparatus 12. The method is provided for controlling (open loop and/or closed loop) the start of the engine. It is assumed that the engine 1 is at standstill and that the pressure pr in the pressure store 14 is low.

After the ignition is switched on in a block 31, the pressure control valve 16 is closed by the control apparatus 12 in a block 32 and the fuel pump 18 is switched on. Likewise, the switchover valve 19 is so controlled that the required fuel from the high pressure pump 18 reaches the pressure store 14. This has overall the consequence that the pressure pr in the pressure store 14 increases. As long as the ignition is switched on and the starter of the engine 1 is not yet actuated, this so-called prerun 33 is maintained.

If the starter of the engine 1 is actuated in accordance with a block 34, then the so-called prerun 33 is interrupted and the pressure pr in the pressure store 14 is measured in a block 35. Thereafter, the pressure pr is compared to a minimum pressure in a block 36.

The minimum pressure prmin is a pressure which is at least required so that the engine 1 can be operated in the stratified operation. The minimum pressure prmin is therefore at least equal to or greater than that pressure at which a blowback from the combustion chamber 4 into the pressure store would take place. The minimum pressure prmin lies approximately in the range from approximately 8 bar up to approximately 15 bar. The minimum pressure prmin can be fixedly pregiven. Likewise, it is possible to determine the minimum pressure prmin (if needed, for each start of the engine 1) by the control apparatus 12 in dependence upon operating variables of the engine 1.

If the pressure pr in the pressure store 14 is less than the minimum pressure prmin, then the fuel for starting the engine 1 is injected into the combustion chamber 4 during the induction phase. The engine 1 is therefore operated in homogeneous operation in accordance with two blocks 37. For this purpose, the injection time point and the injection quantity are determined for the homogeneous operation by the control apparatus 12 and the injection valves 10 and the spark plugs 11 are correspondingly driven by the control apparatus 12.

In block 38, the rpm of the engine 1 is compared to a start-end threshold. If the rpm is greater than the start-end threshold, then the starting of the engine 1 is ended with block 39. If, in contrast, the rpm is less than the start-end threshold, then the pressure pr in the pressure store 14 is again measured and the method is thereafter continued with the block 36.

In this way, it is possible that, in an extreme case, the engine 1 is started completely in the homogeneous operation. Usually, however, the homogeneous operation is maintained only during an initial time duration, especially only during a few revolutions of the engine 1 because, thereafter, the pressure pr in the pressure store 14 has increased such that the engine 1 can be started in the stratified operation as will be explained hereinafter.

If it is determined by the control apparatus 12 in block 36 that the pressure pr in the pressure store 14 is greater than the minimum pressure prmin, then this means that the fuel can be injected into the combustion chamber 4 during the compression phase. The method is thereupon continued in a loop 41.

In the loop 41, the pressure pr in the pressure store 14 is compared first in block 42 to a so-called hysteresis pressure prhys. The hysteresis pressure prhys is less than the minium pressure prmin. The hysteresis pressure serves to build a hysteresis into the loop 41. If the pressure pr again drops below the minimum pressure prmin with a repeated runthrough through the loop 41, then the comparison to the hysteresis pressure prhys in block 42 ensures that this recognized by the control apparatus 12.

If it is recognized within the loop 41 by the control apparatus 12 that the pressure pr in the pressure store 14 is less than the hysteresis pressure prhys, then, thereafter, the fuel is injected into the combustion chamber 4 in the induction phase. Accordingly, the engine 1 is thereafter operated in homogeneous operation in correspondence to blocks 37 and the blocks downstream thereof.

If, however, the pressure pr in the pressure store 14 is greater than the hysteresis pressure prhys, then the pressure pr is compared to a maximum pressure prmax in block 43. The maximum pressure prmax is that pressure which should be present maximally in the pressure store 14.

If the pressure pr in the pressure store 14 is less than the maximum pressure prmax, then the control valve 16 is driven by block 44 in such a manner that the pressure pr in the pressure store 14 continues to increase. Especially the pressure control valve 16 continues to be held closed in order to increase the pressure pr in the pressure store 14.

If the pressure pr in the pressure store 14 is greater than the maximum pressure prmax, then a pressure control is carried out via block 45 and this pressure control limits the pressure pr to the maximum pressure prmax. In this pressure control, it is possible that excess pressure in the pressure store 14 is reduced in such a manner that the pressure control valve 16 is opened and/or the fuel pump 22 and/or the high pressure pump 18 are reduced in their power and/or the switchover valve 19 is switched over in such a manner that the fuel, which is pumped by the high pressure pump, does not reach the pressure store 14 but goes back into the fuel tank 23.

After a runthrough via block 44 or block 45, the fuel is injected into the combustion chamber via the control apparatus 12 during the compression phase. The engine 1 is therefore operated in stratified operation in correspondence to the two blocks 46. For this purpose, the injection time point and the injection quantity are determined by the control apparatus 12 and the injection valves 10 and the spark plugs 11 are correspondingly driven by the control apparatus 12.

In block 47, the rpm of the engine 1 is compared to the already-mentioned start-end threshold. If the rpm is greater than the start-end threshold, then the start of the engine 1 is ended with block 39. If, in contrast, the rpm is less than the start-end threshold, then the pressure pr in the pressure store 14 is again measured in block 48 and the method is thereafter continued with the block 42 of the loop 41.

The above-mentioned start-end threshold is an rpm wherein there is a transition from the starting of the engine 1 into a normal operation of the engine 1. This rpm can be fixedly pregiven in advance. For example, the rpm can be 500 revolutions per minute. Likewise, it is possible that this rpm is determined, if required, for each start of the engine 1, by the control apparatus 12 in dependence upon operating variables of the engine 1.

By means of the loop 41, it is thereby possible to start the engine 1 in stratified operation. In this way, a combined starting of the engine 1 is ensured, first in homogeneous operation and then in stratified operation. At the same time, it is ensured that, for a pressure pr in the pressure store 14 which is too low, there is an immediate return switching to the homogeneous operation.

If, after an operation of the engine 1, the engine is again brought to standstill, then it is possible to control the switchover valve 19 in such a manner that there is no longer a connection between the pressure store 14 and the high pressure pump 18 or the fuel tank 23. Furthermore, the pressure control valve 16 can then be closed. In this way, the pressure store 14 is latched or closed. In this way, the high pressure pr, which is caused by the operation of the engine 1, can be maintained in the pressure store 14 over a longer time, if required, up to a next start of the engine 1.

The described method, especially the operation of the engine 1 in homogeneous operation when the pressure pr in the pressure store 14 is less than the minimum pressure prmin is not limited to the starting of the engine 1; rather, the method can generally be applied to the operation of the engine 1. Especially all steps starting with block 36 of FIG. 3 can be carried out for a normal operation of the engine 1 and can, if required, be carried out continuously.

What is claimed is:

1. A method for starting an internal combustion engine including an engine of a motor vehicle from a cold start state, the method comprising the steps of:

injecting fuel for a combustion directly into a combustion chamber of said engine during an induction phase and during a compression phase;

determining the pressure (pr) with which the fuel is injected into said combustion chamber;

building up said pressure (pr) when starting said engine from said cold or nearly cold start state thereof;

injecting the fuel during the induction phase when the pressure (pr) is less than a pregivable minimum pressure (prmin); and, injecting the fuel during the compression phase when the pressure (pr) is greater than the pregivable minimum pressure (prmin).

2. The method of claim 1, comprising the further step of again injecting the fuel during the induction phase when the pressure (pr) is less than a pregivable hysteresis pressure (prhys) and the hysteresis pressure (prhys) is less than the minimum pressure (prmin).

3. The method of claim 1, comprising the further step of controlling (open loop and/or closed loop) the pressure (pr), with which the fuel is injected into the combustion chamber, to a maximum pressure (prmax).

4. The method of claim 1, wherein the method is used when starting the engine, especially when the rpm of the engine is less than a pregivable start-end threshold.

5. A control element including a read-only-memory for a control apparatus of an internal combustion engine including an engine of a motor vehicle, the control element comprising: a program stored on the control which can be run on a computing apparatus including a microprocessor; and, the program being suitable for carrying out a method for starting said engine from a cold start state and the method including the steps of:

injecting fuel for a combustion directly into a combustion chamber of said engine during an induction phase and during a compression phase;

determining the pressure (pr) with which the fuel is injected into said combustion chamber;

building up said pressure (pr) when starting said engine;

injecting the fuel during the induction phase when the pressure (pr) is less than a pregiven minimum pressure (prmin); and, injecting the fuel during the compression phase when the pressure (pr) is greater than the pregiven minimum pressure (prmin).

6. An internal combustion engine including an engine for a motor vehicle, the engine comprising:

an injection valve with which the fuel, which is to be injected for a combustion, can be injected directly into a combustion chamber during an induction phase and during a compression phase;

a control apparatus for controlling (open loop and/or closed loop) the start of said engine;

a pressure sensor for measuring the pressure (pr) with which the fuel is injected into the combustion chamber;

means for building up said pressure (pr) when starting said engine from a cold start state;

means for injecting the fuel during the induction phase via the control apparatus when the pressure (pr) is less than a pregivable minimum pressure (prmin); and means for injecting the fuel during the compression phase via said control apparatus when the pressure (pr) is greater than the pregivable minimum pressure (prmin).

7. A method for starting an internal combustion engine including an engine of a motor vehicle from a cold start state, the method comprising the steps of:

building up said pressure (pr) when starting said engine from said cold start state and injecting fuel for a combustion directly into a combustion chamber of said engine during an induction phase whereby said engine operates in a homogeneous mode of operation;

measuring the pressure (pr) at which the fuel is injected into said combustion chamber;

continuing to inject the fuel during the induction phase when the pressure (pr) is less than a pregivable minimum pressure (prmin); and, injecting the fuel during the compression phase when the pressure (pr) becomes greater than the pregivable minimum pressure (prmin) so that said engine operates in a stratified mode of operation.

8. The method of claim 7, comprising the further step of again injecting the fuel during the induction phase when the pressure (pr) is less than a pregivable hysteresis pressure (prhys) and the hysteresis pressure (prhys) is less than the minimum pressure (prmin).

9. The method of claim 7, comprising the further step of controlling (open loop and/or closed loop) the pressure (pr), with which the fuel is injected into the combustion chamber, to a maximum pressure (prmax).

10. The method of claim 7, wherein the method is used when starting the engine, especially when the rpm of the engine is less than a pregivable start-end threshold.

* * * * *